United States Patent [19]

Korkut

[11] Patent Number: 4,479,401

[45] Date of Patent: Oct. 30, 1984

[54] BOLT LOCK DEVICE AND METHOD FOR BOLT LOCKING AND UNLOCKING RELATIVELY MOVABLE PARTS OF A RACK AND PINION JACK-UP RIG

[76] Inventor: Mehmet D. Korkut, 2700 Lake Vista Dr., Metairie, La. 70002

[21] Appl. No.: 314,287

[22] Filed: Oct. 23, 1981

[51] Int. Cl.³ ..... G05G 5/06

[52] U.S. Cl. ..... 74/527; 52/125.1; 405/198; 254/108

[58] Field of Search ..... 405/198, 196, 199; 74/527, 578; 52/125.1, 745; 24/263 D, 263 DA; 254/108

[56] References Cited

U.S. PATENT DOCUMENTS

| | | | |
|---|---|---|---|
| 599,026 | 2/1898 | Thomas | 254/108 |
| 4,212,450 | 7/1980 | Lambert | 254/108 |
| 4,255,069 | 3/1981 | Yielding | 405/198 |
| 4,270,877 | 6/1981 | Post | 405/198 |
| 4,329,088 | 5/1982 | Lucas | 405/196 |

FOREIGN PATENT DOCUMENTS

| | | | |
|---|---|---|---|
| 484436 | 10/1975 | Australia | 254/108 |
| 2038982 | 7/1980 | United Kingdom | 74/527 |

*Primary Examiner*—Alexander Grosz
*Assistant Examiner*—Anthony W. Raskob, Jr.

[57] ABSTRACT

A plurality of lock bolts are flexibly stacked in a frame at a lesser angle above the horizontal than the frame is slidably mounted in a rack and pinion jack-up rig's horizontal part. The steeper frame mounting angle reduces sliding friction by the vertical component of gravity. The flatter mounting angle of the lock bolts increases bolt locking efficiency that is a maximum at the horizontal. Free ends of the lock bolts project beyond the frame and are adapted to engage and disengage with the rack of the rack and pinion jack-up rig, the rack being oppositely mounted on the vertical part thereof. The frame is slidably actuated by an hydraulic cylinder pivoted to the horizontal part and the frame. The projecting free ends are roughly wedge shaped for engaging with the rack, and have arcuate lower engaging surfaces and flat upper engaging surfaces, the last of which extend from respective vertical abutments to define a steeper angle than opposing rack engaging surfaces. Individual flexibility in lock bolt mounting is obtained by loosely securing the bolts in the frame and using elastic material for backing and separating the bolts.

10 Claims, 4 Drawing Figures

BOLT LOCK DEVICE AND METHOD FOR BOLT LOCKING AND UNLOCKING RELATIVELY MOVABLE PARTS OF A RACK AND PINION JACK-UP RIG

BACKGROUND OF THE INVENTION

The invention relates generally to locking devices, and more particularly to a bolt lock device and method for locking and unlocking massive relatively movable parts of a rack and pinion jack-up rig.

Heretofore frictional holding devices, subject to slippage, have been used to immobilize massive, relatively movable parts of any jack-up rig because of ease in applying and releasing the frictional device to said movable parts.

The invention teaches a lock bolt device, in combination with a rack of a rack and pinion jack-up rig, that is easily operable to positively lock and unlock said massive parts dependent on the strength of material of the bolt lock device and not on friction introduced between the relatively moving parts.

SUMMARY OF THE INVENTION

Bolt locking vertically movable horizontal and vertical parts of a jack-up rig has been virtually precluded by the great weights of the parts that makes the operation of a bolt lock therebetween practically impossible. It has only to be remembered the amount of force required to unlock and lock a poorly hung, comparatively light door when its weight is partially carried by the bolt and bolt alignment is inexact.

It is an object of the invention to provide a plurality of lock bolts, in each lock bolt device, that are jointly and severally mounted flexibly in said horizontal part of said rig for easy engagement with a rack, rigidly mounted on the vertical part of said rack and pinion jack-up rig, in locking and unlocking therewith, and hence of operation, and for ease of manufacture.

Another object of the invention is to provide a lock bolt device that substitutes linear locking contact for area locking contact between lock bolt and rack of the locking combination for a substantial reduction of moving friction therebetween.

Another object of the invention is to provide apparatus that uses the force of gravity as a part of operating force for unlocking or disengaging the lock bolts of the invention with said rack.

Yet another object of the invention is to provide approximate horizontal bolt movement for maximum bolt locking efficiency with minimal back-out from locking engagement.

A further object of the invention is to provide lock bolt devices with teeth having lower curved supporting surfaces for the vertically movable vertical parts normal to supporting and supported surfaces thereby stabilizing said support.

DETAILED DESCRIPTION

Figure 1:
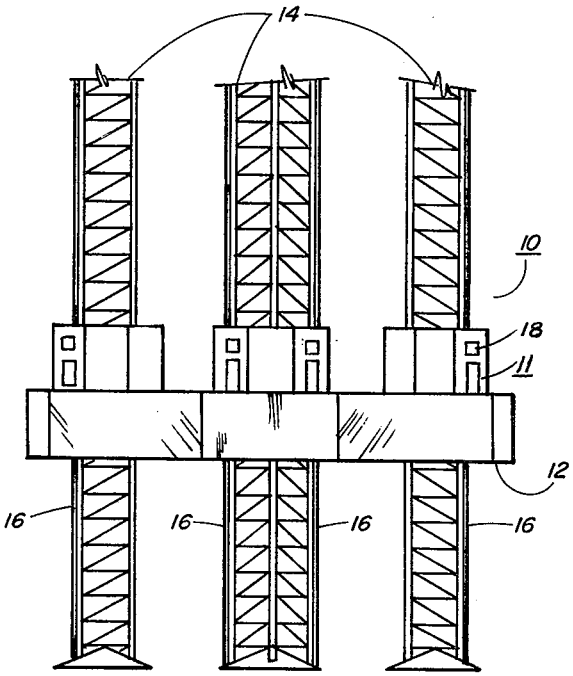
FIG. 1 is a side elevation of a rack and pinion jack-up rig with the invention and pinion drive shown as blocks.
Figure 2:
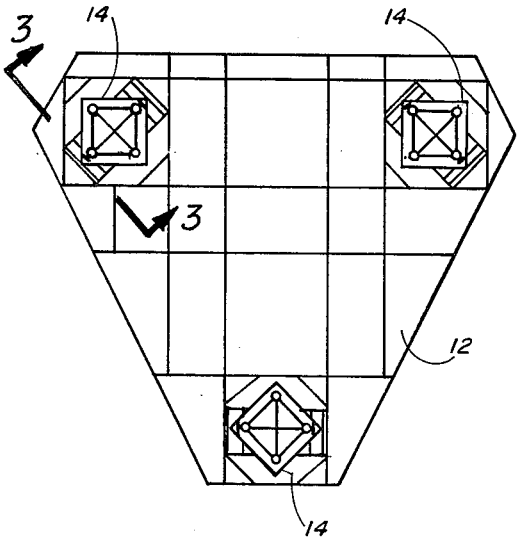
FIG. 2 is a plan view of FIG. 1.
Figure 4:
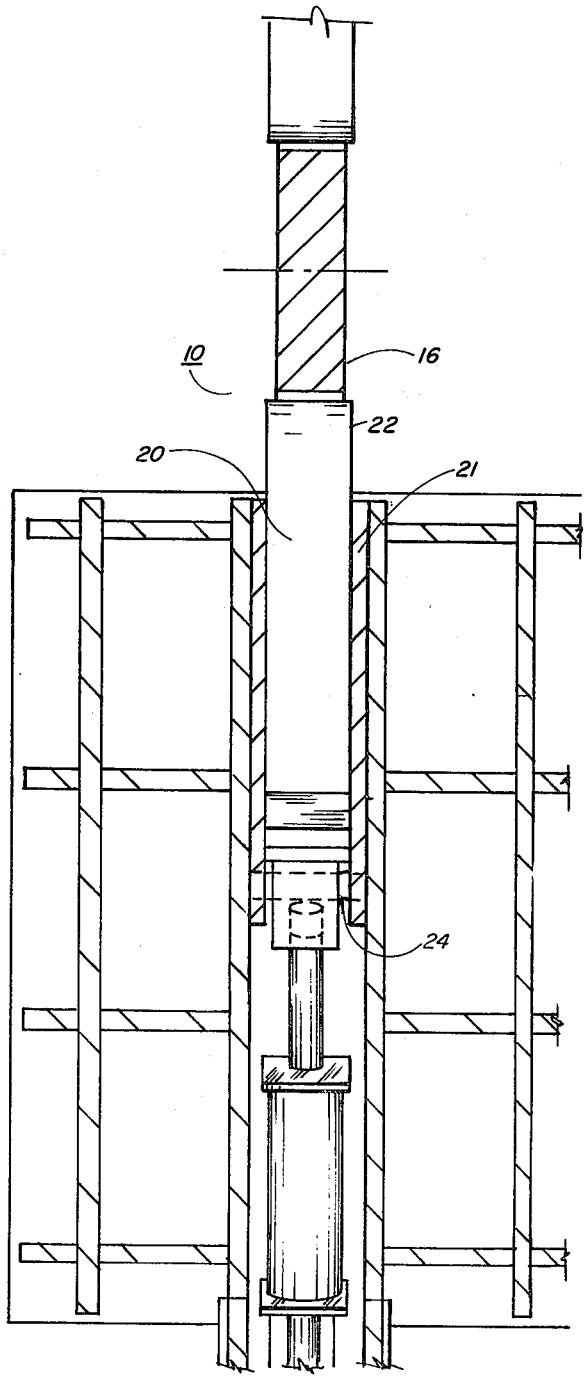
FIG. 4 is a plan view of FIG. 3.
Figure 3:
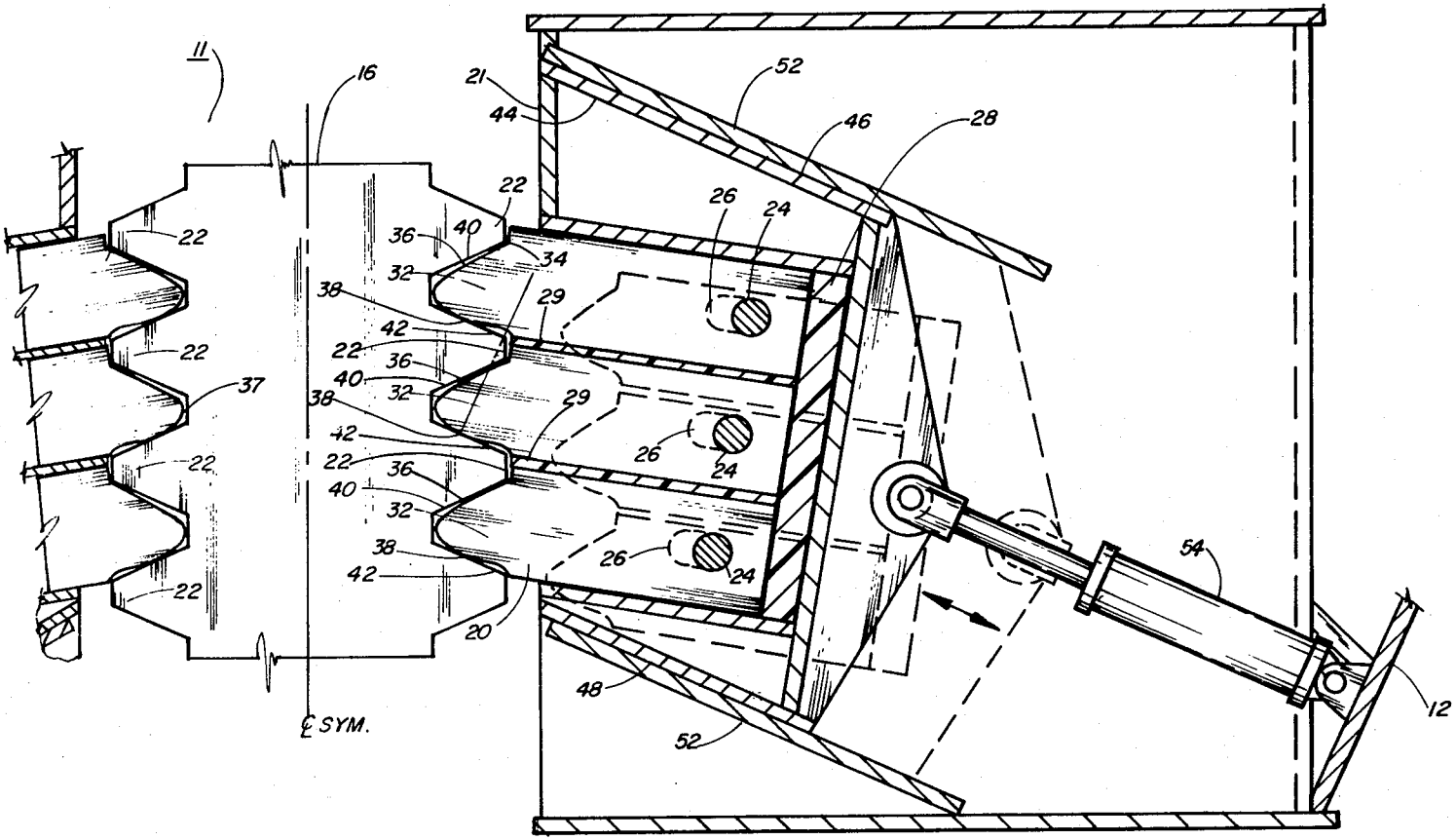
FIG. 3 is an enlarged cross-sectional view taken along section line 3—3 of FIG. 2.

Referring to FIGS. 1–4, the invention comprises a bolt lock device 11 in combination with a rack 16 of a rack and pinion jack-up rig 10. Bolt lock device 11 is mounted in a horizontal part 12 of said rig 10 and adapted to slidably engage conventional flat surfaced, wedge shape (see FIG. 3) rack teeth 22 of rack 16, that is fixed to a vertical part 14 of said rig, for locking said horizontal and vertical parts 12 and 4 against relative vertical movement by said parts, and for taking all vertical stresses normally imposed in said relative movement on pinion 18 (shown only as a block in FIG. 1). Bolt lock device 11 is also adapted to slidably disengage from rack teeth 22 while under said vertical stresses.

Bolt lock device 11 consists of a frame 21 (see FIGS. 3 and 4) mounted at an upwardly inclined angle in the range of 25–30 degrees above horizontal on horizontal part 12 and opposite rack teeth 22 of a rack 16. Frame 21 is adapted to slide its mounting toward and back from said rack teeth. An hydraulic cylinder 54 is pivotally connected to frame 21 and vertical part 14 for actuating said frame limited by the length of the cylinder's working stroke. A number of lock bolts 20, dependent upon the masses of said horizontal and vertical parts, are flexibly mounted, at an angular range of 10 to 15 degrees above the horizontal, in frame 21 with free ends 32 projecting therefrom toward said rack teeth 22 a sufficient distance for the length of said hydraulic stoke to engage said free ends with said rack teeth and disengage therefrom.

Each lock bolt 20 is quadrilaterally shaped and elongated with oppositely disposed ends 31 and 32 that are respectively flat and roughly wedge shaped. End 32 defines an abutment 34 from which a flat wedge surface 36 tapers downwardly to a rounded junction with an upwardly tapering curved wedge surface 38. Said surfaces 40 together define a shorter bolt tooth than the rack teeth. Also a 5 degree steeper taper of flat surface 36 than the taper of the adjacent surface of a rack tooth 22 restricts engagement between the two adjacent surfaces to a transverse linear contact at the base of abutment 34 and adjacent end of the rack tooth. Curved surface 38 also restricts engagement with an adjacent rack tooth flat surface 42 to a linear contact midway between respective bolt and rack teeth ends and bases. Abutment 34 and the shorter length of a bolt tooth restricts longitudinal contact to lock bolt abutment and rack tooth end thereby preventing angular jamming together of said rack and bolt teeth.

Each lock bolt 20 is mounted for both longitudinal and vertical flexibility in frame 21. Longitudinal flexibility is provided by an elastic pad 28 mounted between the back of frame 21 and flat ends 31 of the bolts stacked in said frame. Also each lock bolt is transversely pinned in the frame by a pin 24 fixed in said frame sides and engaging in a hole 26 transversely defined in said lock bolt, said hole 26 having the pin's diameter vertically, but twice said diameter longitudinally for additional longitudinal flexibility. Vertical flexibility is provided by elastic sheets 29 with low friction such as silicone, separating the respective stacked lock bolts 20. The curved lower surface 38 of lock bolt end 32 is defined by a radius centered on a line 39 normal to the contact said curved surface makes with an associated rack tooth flat tooth surface 40, and, when extended upwardly, to frame mounting 52. This line indicates the line of force between supported and supporting sufaces and structures that provides both mechanical and kinetic stability to the relatively movable horizontal and vertical parts of 12 and 14.

In operation, the bolt lock device 11 provides a plurality of lock bolts 20 and teeth 32 for dividing thereamong the total unmanageable friction load between massive, relatively movable, horizontal and vertical parts 12 and 14 of a jack-up rig 10, into respectively manageable friction loads. Independent flexible mounting for each lock bolt and tooth is provided to ensure independently complete engagement between respective bolt teeth 32 and a plurality of successive rigidly mounted rack teeth 22 when in locking engagement. The shape of each bolt tooth 32 provides linear sliding friction rather than area sliding friction between rack teeth 22 contacting surfaces 40 and 42 and bolt teeth contact surfaces 36 and 38 and substantially reducing sliding friction between engaging teeth. Lock bolts 20 are stacked in a frame 21 inclined upwardly at a small angle above the horizontal and engage rack teeth in maximum locking efficiency, while the frame is slidably mounted at a greater angle in horizontal part 12, and disengage said teeth with a larger component of the force of gravity derived from the larger inclination. Teeth 32 and 22 disengaging force, as reduced by gravity, is further reduced by longitudinal flexibility of bolt teeth mounting making simultaneous disengagement improbable, and thereby reducing the total of disengaging forces required. The line of force between supporting and supported surfaces and structures is normal thereto and includes a radial center of an arcuate surface 38 to stabilize the locking relationship between horizontal and vertical parts 12 and 14.

What is claimed is:

1. Lock bolt device means for bolt locking a rack and pinion jack-up rig's horizontal and vertical parts from relative vertical motion, comprising:

(a) a frame, having a closed back and an oppositely disposed open forward end, slidably mounted in said horizontal part at an inclined axis of sliding in the range of 25 to 30 degrees above the horizontal for using gravity in sliding said frame down said inclined axis, and with said open forward end extending upwardly opposite said rack mounted on said vertical part;

(b) a plurality of lock bolts flexibly mounted for limited longitudinal and vertical movement in said frame and inclined less than said inclined axis of sliding of said frame and with free ends projecting forwardly from said frame's forward open end toward said rack and adapted to engage and disengage therewith;

(c) power means pivotally connected to said frame and horizontal part of said rig for sliding said frame and lock lockbolts to engage and disengage said lock bolts' free ends from said rack with minimum operating power and locking effect.

2. Lock bolt device means as described in claim 1 wherein said plurality of lock bolts are stacked one above the other in said frame with longitudinal axes all being inclined at a range of 10 to 15 degrees upwardly and forwardly above the horizontal for approximate horizontal engagement and disengagement of said lock bolts with said rack.

3. Flexibly mounted lock bolts as described in claim 1 wherein flexible mountings therefor comprise:

(a) pin means adapted to respectively engage through said frame in longitudinal elongated holes respectively defined transversely through said lock bolts to loosely connect lock bolts in said frame for limited independent longitudinal movement of each said lock bolt in said frame;

(b) elastic means mounted between said lock bolts and said closed back of said frame for dampening said limited rearwardly movement therebetween; and (c) frictionless elastic means mounted between said lock bolts for providing vertical flexibility with no loss of longitudinal flexibility.

4. Flexibly mounted lock bolts as described in claim 3 wherein said mechanical means comprise:

(a) a plurality of pin means transversely fixable in said frame and normal to respective lock bolts longitudinal axes; and (b) a transverse hole respectively defined in each said lock bolt and adapted to mount respective pins therein, said holes having an axtended diameter along the longitudinal axes of the respective lock bolts for longitudinal movement restricted to the extent and direction of said diameter extension.

5. Flexibly mounted lock bolts as described in claim 3 wherein said elastic means comprise:

(a) a rubber pad backing fixed to the back of said frame.

6. Flexibly mounted lock bolts as described in claim 3 wherein said frictionless elastic means comprise:

(a) separate silicone pads for insertion between each of said stacked lock bolts.

7. Bolt lock device means as described in claim 1 wherein each of said free ends of the lock bolts comprises:

(a) approximately wedge-shaped, rack-engaging surfaces having an upper flat surface and a lower curved surface, both tapering to a rounded common forward end to define shorter rack-engaging surfaces than the rack flat engaged surfaces; and (b) an abutment extending upwardly from each said flat upper surface and oppositley disposed from said common forward end for limiting to the abutment all vertical contact between said lock bolts and rack-engaging surfaces for preventing longitudinal jamming therebetween.

8. Free ends of the lock bolts as described in claim 7 wherein said flat upper surface of said wedged-shaped rack-engaging surfaces comprises:

(a) a sharper taper than that of an engaged flat surface of said rack for limiting contact between said engaging surfaces to a line and thereby reducing friction between said engaging surfaces to line friction.

9. Free ends of the lock bolts as described in claim 7 wherein said lower curved surface of said wedge-shaped rack-engaging surfaces comprises:

(a) an arc of a cylinder having a center, for limiting contact with an engaged flat surface of said rack to a transverse line between said engaging curved and flat surfaces, and for reducing surface friction between said engaging surfaces to linear friction; and (b) said cylindrical arc curved surface being centered on a line normal to said contact limiting transverse line and the inclined axis of sliding of said lock bolt device for stabilizing locking of said engaging surfaces, and thereby of the vertical and horizontal parts of said jack-up rig.

10. A method of bolt locking and unlocking a rack and pinion jack-up rig's horizontal and vertical parts of respectively larger and smaller masses for and against relative vertical movement, comprising the steps of:

(a) mounting in a frame, for limited flexibility, a plurality of lock bolts, with projecting free ends, and with upwardly inclined from the horizontal not more than 15 degrees and not less than 10 degrees for approximately horizontal bolt locking and unlocking:

(b) slidably mounting said frame in said horizontal part opposite the verticle part rack having flat surfaced wedged shaped teeth, and at an inclined axis of sliding above the horizontal or not less than 25 degrees and not more than 30 degrees for reducing sliding friction and increasing the ratio of gravitational forces sliding said frame and lockbolts downward for unlocking said horizontal and vertical parts:

(c) approximately wedge shaping said projecting free ends of the lock bolts for engaging with the wedge shaped teeth of the rack each said free end approximately wedge shaped teeth having an upper flat surface and declining at a steeper angle and shorter than an engaging rack tooth flat surface, and a lower curved surface, the shapes and positioning of each of said surfaces limiting contact therebetween between surfaces, no contact jamming, and for positioning said linear contacts on said surfaces in accordance with said larger and smaller masses of the supporting and supported horizontal and vertical parts at said surface ends for supporting small masses, and between said surface ends for supporting large masses; and (d) pivotally mounting power means between said frame and horizontal part adapted to slide said frame to engage and disengage said lock bolts' free ends approximately wedge shaped teeth with said rack wedge shaped teeth, said power means having a load capacity less than would be required if said frame axis of sliding was not substantially inclined if the approximate wedge shaped flat upper surface of said lock bolt's free ends were not steeper and shorter than said engaged wedge shaped rack teeth, and if the flexible mounting of said lock bolts in said frame did not make a maximum load pick-up relatively gradual rather than immediate.

* * * * *